US008524961B2

(12) United States Patent
Haizmann et al.

(10) Patent No.: US 8,524,961 B2
(45) Date of Patent: Sep. 3, 2013

(54) INTEGRATED CATALYTIC CRACKING AND REFORMING PROCESSES TO IMPROVE P-XYLENE PRODUCTION

(75) Inventors: Robert Haizmann, Rolling Meadows, IL (US); Laura E. Leonard, Western Springs, IL (US)

(73) Assignee: UOP LLC, Des Plaines, IL (US)

( * ) Notice: Subject to any disclaimer, the term of this patent is extended or adjusted under 35 U.S.C. 154(b) by 157 days.

(21) Appl. No.: 13/269,096

(22) Filed: Oct. 7, 2011

(65) Prior Publication Data

US 2013/0087483 A1 Apr. 11, 2013

(51) Int. Cl.

| | |
|---|---|
| ***C07C 7/00*** | (2006.01) |
| ***C10G 57/00*** | (2006.01) |
| ***C10G 55/02*** | (2006.01) |

(52) U.S. Cl.

USPC ..... 585/319; 208/49; 208/60; 208/69; 585/805

(58) Field of Classification Search

USPC ..... 585/319, 805; 208/49, 60, 69

See application file for complete search history.

(56) References Cited

U.S. PATENT DOCUMENTS

| | | | |
|---|---|---|---|
| 4,417,973 | A | 11/1983 | Angevine et al. |
| 4,606,816 | A | 8/1986 | Harandi |
| 4,789,457 | A | 12/1988 | Fischer et al. |
| 5,271,851 | A | 12/1993 | Nelson et al. |
| 5,310,477 | A | 5/1994 | Lomas |
| 5,837,130 | A | 11/1998 | Crossland |
| 5,944,982 | A | 8/1999 | Lomas |
| 6,113,776 | A | 9/2000 | Upson |
| 6,900,365 | B2 | 5/2005 | Chen et al. |
| 2010/0230324 | A1 | 9/2010 | Al-Alloush et al. |
| 2010/0243527 | A1 | 9/2010 | Lomas et al. |
| 2010/0331589 | A1 | 12/2010 | Zimmermann et al. |

OTHER PUBLICATIONS

Laird, D., Fractionation impact on FCC gasoline and LCO sulfur content, NPRA Annual Meeting Papers, v 2002, 16p, 2002; Conference; 2002 Annual Meeting—National Petrochemical and Refiners Association, Mar. 17-19, 2002.

De Rezende Pinho, A.; Gilbert, W.R.; Montaury Pimenta, R.D. , Influence of feed hydrotreatment on FCC product aromatics, 2004 AIChE Spring Meeting, Conference Proceedings, 2004; ISBN-10: 0816909423; Conference: 2004 AIChE Spring Meeting, Conference Proceedings, Apr. 25-29, 2004; Sponsor: American Institute of Chemical Engineers, AIChE.

*Primary Examiner* — Thuan D Dang

(74) *Attorney, Agent, or Firm* — Mark R Willis

(57) ABSTRACT

A process for maximizing p-xylene production includes producing a naphtha fraction and a light cycle oil fraction from a fluid catalytic cracking zone. These fractions are combined and hydrotreated. Fractionation of the hydrotreated product makes a hydrocracker feed that is sent to a hydrocracking zone to make a naphtha cut and a hydrocracker product. The hydrocracker product is recycled back to the fractionation zone, and the naphtha cut is dehydrogenated in a dehydrogenation zone to make aromatics. Reforming catalyst from a catalyst regenerator moves downward through the dehydrogenation zone. Straight run naphtha and raffinate from the aromatics unit are introduced to an additional series of reforming zones. The reforming catalyst moves in parallel through the first reforming zone and the dehydrogenation zones, then is combined for entry to the second and subsequent reforming zones prior to regeneration.

17 Claims, 2 Drawing Sheets

INTEGRATED CATALYTIC CRACKING AND REFORMING PROCESSES TO IMPROVE P-XYLENE PRODUCTION

CROSS REFERENCE TO RELATED APPLICATIONS

This application is related to U.S. Ser. Nos. 13/269,075, and 13/268,883, each filed concurrently herewith and herein incorporated by reference.

BACKGROUND OF THE INVENTION

Refineries include a large number of processing steps to make a wide variety of hydrocarbon products. These facilities are very versatile, enabling them to vary the product slate to accommodate changes in season, technologies, consumer demands and profitability. Hydrocarbon processes are varied yearly to meet seasonal needs for gasoline in the summer months and heating oils in the winter months. Availability of new polymers and other new products from hydrocarbons causes shifts in product distributions. Needs for these and other petroleum-based products results in continuously changing product distribution from among the many products generated by the petroleum industry. Thus, the industry is constantly seeking process configurations that produce more of the products that are higher in demand at the expense of less profitable goods.

Most new aromatics complexes are designed to maximize the yields of benzene and para-xylene ("p-xylene"). Benzene is a versatile petrochemical building block used in many different products based on its derivation including ethylbenzene, cumene, and cyclohexane. Para-xylene is also an important building block, which is used almost exclusively for the production of polyester fibers, resins, and films formed via terephthalic acid or dimethyl terephthalate intermediates. Thus, the demand for plastics and polymer goods has created a need in the refining industry for generation of large amounts of aromatics, including benzene, xylenes, particularly p-xylene, and other feedstocks for an aromatics plant.

SUMMARY OF THE INVENTION

A process for maximizing p-xylene production begins by producing a naphtha fraction and a light cycle oil fraction from a fluid catalytic cracking zone. The naphtha and light cycle oil fractions are combined and hydrotreated to produce a hydrotreated product. Fractionation of the hydrotreated product in a fractionation zone makes a light ends cut, a naphtha cut, a hydrocracker feed and an unconverted oil fraction. The hydrocracker feed is sent to a hydrocracking zone to make a hydrocracker product, which is then recycled back to the fractionation zone, feeding the hydrocracker product above an outlet for the hydrocracker feed, but below an outlet for the naphtha cut. The naphtha cut is fed to a dehydrogenation zone, the dehydrogenation zone comprises a first portion of regenerated reforming catalyst from a catalyst regenerator. The regenerated reforming catalyst moves downward through the dehydrogenation zone in a moving bed as it starts to become lightly coked catalyst. A product stream from the dehydrogenation zone flows through a heat exchanger then to an aromatics extraction unit. At the aromatics extraction unit, an aromatic-rich extract is withdrawn from the dehydrogenation product stream with a raffinate having the remainder of the dehydrogenation zone components.

Straight run naphtha and the raffinate are heated prior to introduction to a first reforming zone, the first reforming zone comprising a second portion of regenerated reforming catalyst from the catalyst regenerator. The regenerated reforming catalyst moves downwardly through the first reforming zone as it starts to become a lightly coked catalyst. The lightly coked catalyst is removed from the bottom of each of the first reforming zone and the dehydrogenation zone and is fed to the top of the second reforming zone. An effluent from the first reforming zone is heated and fed to a second reforming zone. The lightly coked reforming catalyst moves downward through the second reforming zone as it becomes partially coked reforming catalyst;

The partially coked reforming catalyst is removed from the second reforming zone and fed to a third reforming zone. Meanwhile, an effluent from the second reforming zone is heated and fed to the third reforming zone where it contacts the partially spent reforming catalyst. The moving bed system moves the partially spent reforming catalyst downwardly through the third reforming zone as it becomes a substantially spent catalyst. At the bottom of the third reforming zone, the substantially spent reforming catalyst is removed from the third reforming zone and regenerated in the catalyst regenerator.

One surprising aspect of this process is that selectivity to make naphtha increases as the conversion in the hydrocracking unit decreases. The recycle of the hydrocracker products through the fractionation zone and back to the hydrocracking unit allows the hydrocracking unit to run at low conversion per pass, thereby increasing the overall selectivity for products in the boiling range of about 93° C. (200° F.) to about 177° C. (350° F.).

It was also discovered that selectivity to aromatics also increases as conversion in the hydrocracking unit decreases. As discussed above, recycle of the products from the hydrocracking zone is used to generate high yields of aromatics. Even at low conversion per pass the improved selectivity and large number of passes generate sufficient aromatics as feedstock for an aromatics recovery unit.

DETAILED DESCRIPTION OF THE INVENTION

Figure 1:
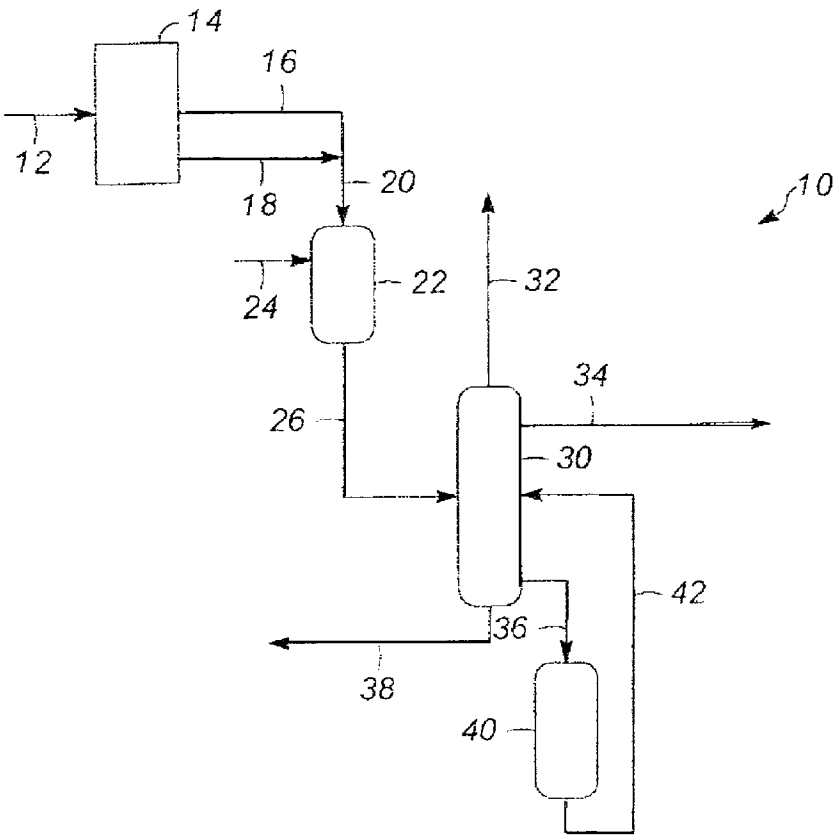
FIG. 1 is a flow diagram showing an embodiment of the feedstock preparation section of the integrated process of the present invention.
Figure 2:
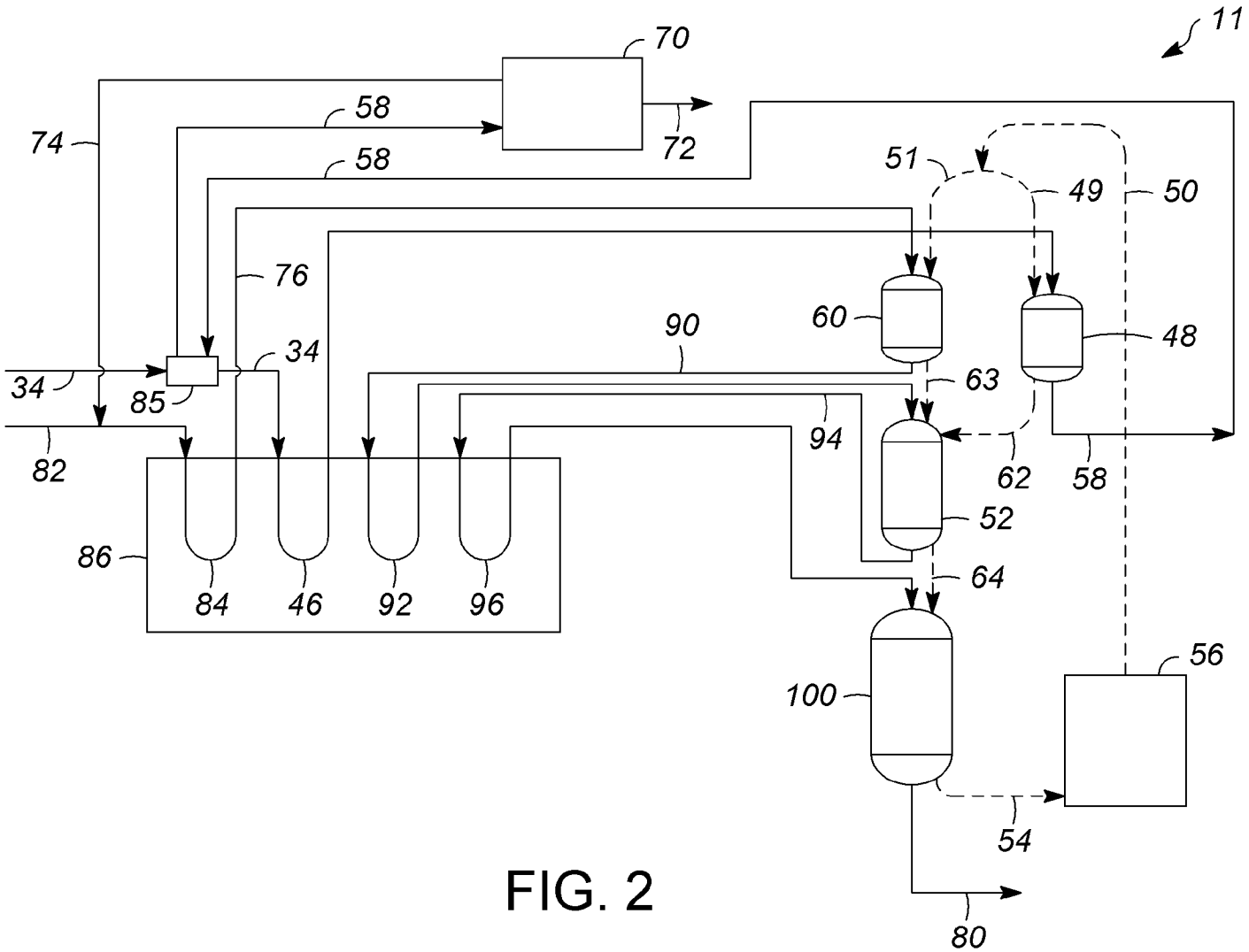
FIG. 2 is a flow diagram showing an embodiment of the reforming section of the integrated process of the present invention.

An integrated process includes a feedstock preparation section, generally 10 FIG. 1), and a reforming section, generally 11 (FIG. 2). Referring to FIG. 1, the process converts a hydrocarbonaceous feedstock 12 containing high boiling range hydrocarbons into a diesel range boiling hydrocarbons into products that include a large amount of p-xylene. Generally, the hydrocarbonaceous feedstock includes high boiling range hydrocarbons that boil in a range greater than a light cycle oil ("LCO"). A preferred feedstock is a vacuum gas oil ("VGO"), which is typically recovered from crude oil by vacuum distillation. A VGO hydrocarbon stream generally has a boiling range between about 315° C. (600° F.) and about 565° C. (1050° F.). An alternative feedstock 12 is residual oil, which is a heavier stream from the vacuum distillation, generally having a boiling range above 499° C. (930° F.).

Referring to FIG. 1, the selected feedstock is introduced into a fluid catalytic cracking zone ("FCC") 14 and contacted with a catalyst composed of finely divided particulate catalyst. The reaction of the feedstock in the presence of catalyst is accomplished in the absence of added hydrogen or the net consumption of hydrogen. As the cracking reaction proceeds, substantial amounts of coke are deposited on the catalyst. The catalyst is regenerated at high temperatures by burning coke from the catalyst in a regeneration zone. Carbon-containing catalyst, referred to herein as "coked catalyst," is continually transported from the reaction zone to the regeneration zone to be regenerated and replaced by carbon-free regenerated catalyst from the regeneration zones. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones and combusting coke in the regenerator are well known by those skilled in the art of fluidized catalytic cracking ("FCC") processes.

The FCC catalyst (not shown) is optionally a catalyst containing, medium or smaller pore zeolite catalyst exemplified by ZSM-5, ZSM-11, ZSM-12, ZSM-23, ZSM-35, ZSM-38, ZSM-48, and other similar materials. U.S. Pat. No. 3,702,886 describes ZSM-5. Other suitable medium or smaller pore zeolites include ferrierite, erionite, and ST-5, developed by Petroleos de Venezuela, S. A. The second catalyst component preferably disperses the medium or smaller pore zeolite on a matrix comprising a binder material such as silica or alumina and an inert filer material such as kaolin. The second component may also comprise some other active material such as Beta zeolite. These catalyst compositions have a crystalline zeolite content of 10 to 25 wt-% or more and a matrix material content of 75 to 90 wt-% or less, each percentage based on the total catalyst weight. Catalysts containing 25 wt-% crystalline zeolite materials are preferred. Catalysts with greater crystalline zeolite content may be used, provided they have satisfactory attrition resistance. Medium and smaller pore zeolites are characterized by having an effective pore opening diameter of less than or equal to 0.7 nm, rings of 10 or fewer members and a Pore Size Index of less than 31. The residence time for the feed in contact with the catalyst in a riser is less than or equal to 2 seconds. The exact residence time depends upon the feedstock quality, the specific catalyst and the desired product distribution. The shorter residence time assures that the desired products, such as light olefins, do not convert to undesirable products. Hence, the diameter and height of the riser may be varied to obtain the desired residence time.

Still referring to FIG. 1, products of the FCC include light ends, a gasoline fraction, or naphtha, 16 and a light cycle oil fraction 18. The naphtha fraction 16 and the light cycle oil fraction 18 are combined into a single stream 20 and fed to a hydrotreating zone 22. For the purposes of this patent application, "hydrotreating" refers to a processing zone 22 where a hydrogen-containing treat gas 24 is used in the presence of suitable catalysts that are primarily active for the removal of heteroatoms, such as sulfur and nitrogen. The hydrotreating zone 22 may contain a single or multiple reactors (preferably trickle-bed reactors) and each reactor may contain one or more reaction zones with the same or different catalysts.

The hydrotreating zone 22 operates to reduce the levels of sulfur and other contaminates in the combined naphtha and light cycle oil fraction 20 to produce a hydrotreated product 26 at the appropriate quality levels to be used as feedstock to a catalytic reformer (not shown). The combined naphtha and light cycle oil feedstock 20 and hydrogen treat gas 24 are contacted with a suitable catalyst at hydrotreating conditions to reduce the level of contaminates in the hydrocarbonaceous stream to generally meet desired levels of sulfur, nitrogen and hydrogenation. For example, the hydrotreating reaction zone 22 may produce a hydrotreated product 26 having a reduced concentration of sulfur of about 20 to less than 1 ppm by weight, or, in some embodiments, less than 1 ppm by weight and/or a reduced concentration of nitrogen of about less than 30 ppm by weight, more preferably from about 0.2 to about 1 ppm by weight. The exact contaminate reduction depends on a variety of factors such as the quality of the feedstock, the hydrotreating conditions, the available hydrogen, and the hydrotreating catalyst, among others.

The hydrotreating zone 22 in one aspect operates at relatively mild conditions generally not over about 454° C. (850° F.) and 17.3 MPa (2500 psig) in order to reduce overtreating the higher boiling hydrocarbons. At severe conditions, a high degree of cracking occurs, often cracking the desired products, such as naphtha, to less valuable light ends. In general, the hydrotreating reaction zone 22 operates at a temperature from about 315° C. (600° F.) to about 426° C. (800° F.), a pressure from about 3.5 MPa (500 psig) to about 17.3 MPa (2500 psig), and a liquid hourly space velocity from about 0.1 $hr^{-1}$ to about 10 $hr^{-1}$.

Suitable hydrotreating catalysts for use herein are any known conventional hydrotreating catalyst and include those that are comprised of at least one Group VIII metal (preferably iron, cobalt and nickel, and more preferably cobalt and/or nickel) and at least one Group VI metal (preferably molybdenum and/or tungsten) on a high surface area support material, preferably alumina. Other suitable hydrotreating catalysts include zeolitic catalysts, as well as noble metal catalysts where the noble metal is selected from palladium and platinum. It is within the scope herein that more than one type of hydrotreating catalyst can be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Of course, the particular catalyst compositions and operating conditions may vary depending on the particular hydrocarbons being treated, the concentration of heteroatoms and other parameters. All weight percentages of catalyst components are based on the total weight of the catalyst.

The effluent from the hydrotreating zone 26 is introduced into a main fractionation zone 30. In one embodiment, the main fractionation zone 30 is a hot, high pressure stripper to produce a first vapor stream 32 including hydrogen, hydrogen sulfide, ammonia and $C_2$ through $C_4$ gaseous products. This vapor stream 32 is often referred to as the light ends cut. A naphtha cut 34, including $C_{10}$-aromatic hydrocarbons is removed in an intermediate cut. A heavy hydrocarbon stream 36 of the unconverted fuel oil is fed to a hydrocracking zone 40. A stream of unconverted diesel and heavier range material 38 is optionally removed from that is not converted to naphtha or recycled back to the hydrocracking zone. The hot, high pressure stripper is preferably operated at a temperature from about 149° C. (300° F.) to about 288° (550° F.) and a pressure from about 3.5 MPa (500 psig) to about 17.3 MPa (2500 psig). In another embodiment (not shown), the main fractionation zone 30 is operated at a lower pressure, such as atmospheric pressure, and operating without specific hydrogen stripping.

In one aspect, the hydrocracking zone 40 may contain one or more beds of the same or different catalysts. In one such aspect, the preferred hydrocracking catalysts utilize amorphous bases or low-level zeolite bases combined with one or more Group VIII or Group VIB metal hydrogenation components. In another aspect, the hydrocracking zone 40 contains a catalyst which comprises, in general, any crystalline zeolite cracking base upon which is deposited a minor proportion of a Group VIII metal hydrogenating component. Additional hydrogenation components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms.

It is preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. An example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 to Rabo et al., which is hereby incorporated by reference in its entirety.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least about 20 percent, metal-cation-deficient, based on the initial ion-exchange capacity. A specifically desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, including iron, cobalt, nickel, ruthenium, rhodium, palladium, osmium, iridium and platinum. In addition to these metals, other promoters may also be employed in conjunction therewith, including the metals of Group VIB, such as molybdenum and tungsten. The amount of hydrogenating metal in the catalyst can vary within wide ranges. Broadly speaking, the catalyst includes any amount of metal between about 0.05 percent and about 30 percent by weight. In the case of the noble metals, it is normally preferred to use about 0.05 to about 2 weight percent.

In some embodiments, a method for incorporating the hydrogenating metal is to contact the zeolite base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like, if desired, and calcined in air at temperatures of, e.g., about 371° to about 648° C. (about 700° to about 1200° F.) to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and about 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718, which is hereby incorporated by reference in its entirety.

In one aspect of the process, the feedstock 36 for the hydrocracking zone 40 is exposed to hydrogen and is contacted with the hydrocracking catalyst at hydrocracking conditions to achieve conversion levels between about 40% and about 85 percent. At low conversion, selectivity for naphtha production, as well as selectivity for aromatics content in the naphtha, are both improved. A secondary goal is to maintain sufficiently low sulfur and nitrogen contaminants in the naphtha cut 34 to feed a reforming unit without additional hydrotreating. The hydrocracker product 42 also includes some diesel range material, preferably low and most preferably ultra low sulfur diesel (i.e., less than about 10 ppm by weight sulfur) with an improved cetane number (i.e., about 40 to about 55).

Other conversion levels also may be used depending on the content of the feedstock 36 to the hydrocracking zone 40, flowrates through the hydrocracking zone 40, the catalyst systems, hydrocracking conditions, and the desired product qualities, among other considerations. In one aspect, the operating conditions to achieve such conversion levels include a temperature range from about 90° C. (195° F.) to about 454° C. (850° F.), a pressure range from about 3.5 MPa (500 psig) to about 17.3 MPa (2500 psig), a liquid hourly space velocity ("LHSV") from about 0.1 to about 10 $hr^{-1}$, and a hydrogen circulation rate from about 84 normal $m^3/m^3$ (500 standard cubic feet per barrel) to about 4200 $m^3/m^3$ (25,000 standard cubic feet per barrel). In some embodiments, the temperature ranges from about 371° C. (700° F.) to about 426° C. (800° F.). The hydrocracking conditions are variable and are selected on the basis of the feedstock 36 composition, desired aromatics content and the nature and composition of the naphtha cut 34 used to provide feedstock to the dehydrogenation zone 48.

Products from the hydrocracking zone 40 are recycled to the fractionation zone 30, feeding the hydrocracker product 42 above an outlet for the hydrocracker feed 36, but below an outlet for the naphtha cut 34. Light ends 32 and the naphtha cut 34 produced in the hydrocracking zone 40 are separated in the fractionation zone 30 and drawn off with their respective streams. Unreacted cycle oil is driven toward the bottom of the fractionation zone 30 where it is drawn off with gas oil newly received from the FCU in the hydrocracker feed stream 36 to return to the hydrocracking zone 40. In this manner, the light gas oil is recycled to extinction.

The naphtha cut 34 from the fractionation zone 30 is the feedstock to the reforming section 11. In the reforming section, the naphtha cut 34 goes to a dehydrogenation zone 48 to make a dehydrogenated naphtha 58. Dehydrogenation also occurs in the first stage or first section of the catalytic reformer 60. Hydrogen is removed from the hydrocarbon compounds to make olefinic and aromatic compounds. Naphthenes, such as cyclohexane, are converted to aromatics including benzene, toluene and xylene.

The naphtha cut 34 is a feedstock to the dehydrogenation zone 48. It is heated in a first charge heating zone 46 to a temperature of about 800° F. (427° C.) to about 1000° F. (538° C.), then directed to the dehydrogenation zone 48. The pressure of the dehydrogenator zone 48 is from about 2.5 to about 35 kg/cm$^2$ and the dehydrogenator zone operates at a liquid hourly space velocity of about 0.1 hr$^{-1}$ to about 20 hr$^{-1}$. A reforming catalyst 49, described below, is present in the dehydrogenation zone 48.

Shown in FIG. 2, in a preferred embodiment, the dehydrogenation zone 48 employs a moving catalyst bed reaction zone and regeneration section 56. The first portion of regenerated catalyst 49 particles is fed to the dehydrogenation reaction zone 48 and the catalyst particles flow downward through the zone by gravity. For the purposes of this invention, "regenerated" catalyst particles 49 are unused catalyst particles, regenerated catalyst particles and mixtures thereof. As the catalyst moves through the beds 48, 52, 60, 100, catalyst particles rub against each other, the reactor interior and the transfer mechanism used to transfer catalyst particles from one reaction zone 48, 52, 60, 100 to another zone or the regenerator 56. The new, unused catalyst particles are optionally added to replace used parts of the catalyst particles worn away due to erosion. Reference to the catalyst as "regenerated catalyst" or "used catalyst" is intended to include a catalyst that includes fresh replacement catalyst as needed. Replacement catalyst is typically added in amounts of about 0.01 wt % to about 0.10 wt % based on the catalyst circulation rate.

The first portion of regenerated catalyst 62 is withdrawn from the bottom of the dehydrogenation reaction zone 48 and transported to the second reforming zone 52 of the multiple reforming zones 52, 60, 100. Stacking of the multiple reforming zones 52, 60, 100 allows the catalyst 50 to move through the multiple zones by gravity. Preferably, the dehydrogenation zone 48 is also positioned to allow transfer of the catalyst 62 from the dehydrogenation zone 48 to the second reforming zone 52 by gravity. After the catalyst particles 54 have moved through all of the multiple reforming zones 52, 60, 100, the catalyst particles 54 are removed from the bottom of the reaction zone 100 to a regeneration zone 56. Discrete batches of spent catalyst particles 54 are removed from the bottom of the last reforming zone 100 and batches of regenerated catalyst 50 are added to the top of the reaction zones 48, 60. Although catalyst entry and exit from the reaction zones 58, 52, 60, 100 is done using a semi-continuous method, the total catalyst bed acts as if it were continuously moving through the reaction 48, 52, 60, 100 and regeneration zones 56.

As the catalyst particles interact with the feedstock, some reactions cause deposition of carbon on the surface of the catalyst, known as "coking." Moving through the reaction zones, coking of the catalyst becomes progressively more severe due to build up of the coke. In the dehydrogenation 48 and first reforming zones 60, the regenerated catalyst 49, 51 particles become lightly coked. The lightly coked catalyst 62, 63 enters the second reforming zone 52. Additional coke is deposited in the second reforming zone 52 so that, by the time it exits the second reforming zone 52, the catalyst 64 is partially coked. In the third reforming zone 100, coking continues and the partially coked catalyst becomes substantially spent 54. This results in reduced activity of the catalyst due to blocking of the catalytic reaction sites. In the regeneration zone 56, the coke is burned from the spent catalyst 54 and the catalytic activity is restored. The catalyst particles are contacted with hot, oxygen-containing gas, oxidizing the coke to a mixture of carbon monoxide, carbon dioxide and water. Regeneration generally occurs at atmospheric pressure and at temperatures of from about 482° C. to about 538° C. (900-1000° F.), however, localized temperatures within the regeneration zone often range from about 400° C. to about 593° C. (750° F. to about 1100° F.). Regenerated catalyst 50 is recycled back to the dehydrogenation zone 48 and the first reforming zone 60 as the first and second portion of the regenerated catalyst 49, 51. Additional details regarding regeneration of catalyst in a moving bed process is discussed in U.S. Pat. No. 7,858,803, herein incorporated by reference.

The product stream 58 from the dehydrogenation unit 48 is sent to exchange heat in heat exchanger 85 with the feed naphtha cut 34 in a heat exchanger 85 then goes to an aromatics extraction unit 70. In some embodiments, the extraction unit 70 is a UOP Sulfolane™ Process, however, any aromatics extraction process is suitable. An aromatics-rich stream 72 and a raffinate stream 74 are withdrawn from the aromatics extraction unit 70. Regardless of the extractant used, the aromatics-rich stream 72 is sent to an aromatics plant for further processing. An example of further processing includes conversion of the aromatics to terephthalic acid, followed by esterification of the terephthalic acid to polyethylene terephthalate.

The raffinate 74 from the aromatics extraction process is used as a feedstock to the first catalytic reforming zone 60. The first reforming zone feedstock 76 includes hydrocarbons from $C_6$ to about $C_{12}$ with a boiling point range of from about 82° C. (180° F.) to about 204° C. (399° F.). In the catalytic reforming zones 52, 60, 100, the octane number of the feedstock is increased by dehydrogenation of naphthenes, isomerization of paraffins and paraffin dehydrocyclization. The product of the reforming zone 80, also known as reformate, is frequently used for gasoline blending. In some cases, the reformate 80 is used as a feedstock for a second aromatics extraction unit (not shown) where aromatics are removed for use in petrochemicals or it can be fed to the aromatics extraction unit.

Straight run naphtha 82 and the raffinate 74 are heated in a second charge heating zone 84, optionally combined and then fed to a first reforming zone 60. The straight run naphtha 82 is typically obtained from the crude distillation tower (not shown), however, it is contemplated that the naphtha be treated in some way. It may, for example, be sent to a hydrotreater to reduce the amount of sulfur or nitrogen in the naphtha. The straight run naphtha 82 and raffinate 74 are optionally combined either prior to entering the second charge heating zone 84, after entering the second change heating zone 84 or after leaving the second charge heating zone 84. The second charge heating zone 84 is optionally a separate zone from the first charge heating zone 46 within the same heating device 86, such as a furnace or kiln. Use of separate heating devices for the first and second charge heating zones 46, 84 is also suitable. First 92 and second 96 interstage heating zones may be housed within the same heating device 86 as the first 46 and second 84 charge heating zones, or the first 92 and second 96 interstage heating zones may be in a different heating device (not shown) from the first 46 and second charge heating zone 84 or in a different heating device from each other. Temperatures of the raffinate 74 and the straight run naphtha 82 are increased to the range of about 427° C. (800° F.) to about 538° C. (1000° F.).

Reforming zone 52, 60, 100 conditions include pressures from about atmospheric to about 6080 kPaa. In some embodiments, the pressure is from atmospheric to about 2026 kPaa (300 psig), and a pressure below 1013 kPaa (150 psig) is particularly preferred. Hydrogen is generated in a reforming zone 52, 60, 100 by dehydrogenation reactions. However, in some embodiments, additional hydrogen is inserted into the reforming zone 52, 60, 100. The hydrogen is present in each of the reforming zones 32, 40, 80 in amounts of about 0.1 to about 10 moles of hydrogen per mole of hydrocarbon feedstock. The catalyst volume corresponds to a liquid hourly space velocity of from about 0.5 $hr^{-1}$ to about 40 $hr^{-1}$. Operating temperatures are generally in the range from about 260° C. (500° F.) to about 560° C. (1040° F.).

The reforming catalyst used in both the dehydrogenation zone 48 and the reforming zones 51, 54, 64, is any known reforming catalyst. This catalyst is conventionally a dual-function catalyst that includes a metal hydrogenation-dehydrogenation catalyst on a refractory support. Cracking and isomerization reactions take place on acidic sites of the support material. The refractory support material is preferably a porous, adsorptive, high surface-area material such as silica, alumina, titania, magnesia, zirconia, chromia, thoria, boria or mixtures thereof; clays and silicates which are optionally acid-treated; crystalline zeolite aluminosilicates, either naturally occurring or synthetically prepared, including FAU, MEL, MFI, MOR or MTW (using the IUPAC Commission on Zeolite Nomenclature), in hydrogen form or in a form that has been exchanged with metal cations; non-zeolitic molecular sieves as disclosed in U.S. Pat. No. 4,741,820, herein incorporated by reference; spinels, such as $MgAl_2O_4$, $FeAl_2O_4$, $ZnAl_2O_4$, $CaAl_2O_4$; and combinations of materials from one or more of these groups.

A preferred support material for reforming is alumina with gamma- or eta-alumina being used most frequently. Alumina supports, such as those described as being a by-product of a Ziegler higher alcohol synthesis, known as a "Ziegler alumina," are particularly suitable. Such catalysts are described in U.S. Pat. No. 3,852,190 and U.S. Pat. No. 4,012,313, hereby incorporated by reference. Ziegler aluminas are available from Vista Chemical Company under the trademark CATAPAL or from Condea Chemie GmbH under the trademark PURAL. This material is an extremely high purity pseudo-boehmite powder, which, after calcination at a high temperature, yields a high-purity gamma-alumina.

An alternate reforming catalyst is a non-acidic L-zeolite, an alkali-metal component and a platinum group metal. To be "non-acidic" the L-zeolite has substantially all of its cationic exchange sites occupied by non-hydrogen atoms. In some embodiments, the cationic exchange sites are occupied by alkali metals, such as potassium. The L-zeolite is composited with a refractory binder to hold it together in a particle form. Any refractory oxide is useful as the binder, including silica, alumina and magnesia. Amorphous silica is particularly useful when made from a synthetic white silica powder precipitated as ultra-fine spherical particles from a water solution. The silica powder is non-acidic, contains less than 0.3% sulfate salts and has a BET surface area of from about 120 $m^2/g$ to about 160 $m^2/g$.

One or more platinum group metals are deposited on the surface of the catalyst. The term "surface" is intended to include, not only the exterior particle surface, but also any surfaces accessible by the reformer feedstock, including surfaces on the interior pores of the support material. The platinum group metal is present as the elemental metal, an oxide, a sulfide, an oxyhalide or in chemical combination with any component of the support material. In some embodiments, the platinum group metal is in a reduced state. When calculated as a weight percentage of the catalytic composite, the platinum group metal is from about 0.01 wt-% to about 2.0 wt-%, preferably from about 0.05 wt-% to about 1.0 wt-% based on the total catalyst weight.

The reforming catalyst optionally includes one or more additional metal components as are known to modify the activity or selectivity of the catalyst. The additional metal components include, but are not limited to, Group IVA metals, Group VIII metals other than platinum group metals, rhenium, indium, gallium, zinc, uranium, dysprosium, thallium and mixtures thereof. Tin is the additional metal component in at least one embodiment of the invention. The additional metal components are used in catalytically effective amounts and are incorporated onto the reforming catalyst by any method known in the art.

Optionally, the reforming catalyst includes a halogen adsorbed on the catalyst surface to provide an acidic reaction site. Suitable halogens include fluorine, chlorine, bromine, iodine or mixtures thereof. Chlorine is a preferred halogen component. The halogen is generally dispersed over the catalyst surface and is about 0.2% to about 15% of the catalyst by weight based on the total catalyst weight and calculated on an elemental basis. Details of the catalyst preparation are disclosed in U.S. Pat. No. 4,677,094, herein incorporated by reference.

Many of the reactions taking place in the reforming zones 52, 60, 100, such as dehydrogenation, are endothermic. Unless substantial heat is added to the reactor during processing, the temperature of the fluid passing through the reactor drops in temperature. In an adiabatic system, interstage heating is utilized to maintain reaction at desirable reaction rates. Effluent from the first reforming zone 60 is reheated in the first interstage heating zone 92 prior to introducing it as the feedstock to the second reforming zone 52. Similarly, the effluent from the second reforming zone 52 is reheated in the second interstage heater zone 96 prior to its introduction to the third reforming zone 100.

Although the present process is described in terms of three reforming zones 52, 60, 100, it is to be understood that this method could be used with two, four or even more reforming zones. In each case, the feedstock of each reforming zone 52, 100 beyond the first reforming zone 60 is the reheated effluent of the prior reforming zone. The catalyst 63, 64 entering the second and third reforming zones 52, 100 comes from the previous reforming zone 60, 52 and becomes progressively more covered with coke as it progresses through successive reforming zones. After the final reforming zone 100, the spent catalyst 54 is regenerated. Following regeneration 56, the reforming catalyst 50 again starts moving downward through the reaction zones, beginning in the dehydrogenation zone 48 or the first reforming zone 60, then moving downward through the second 52, third 100, and subsequent reforming zones, if the number of reforming zones exceeds three.

After the third or final reforming zone 100, the reformate 80 is optionally separated into multiple products. Typically, the various products are separated at least partly by boiling point. For example, $C_4$-hydrocarbons are often processed with other light ends to recover ethylene and propylene. Single ring aromatics are sent to an aromatics extraction zone where they are recovered. As discussed above, raffinate from aromatics extraction is added to the reformer feedstock for isomerization to naphthenes and dehydrogenation to aromatics.

This process is useful to improve both the quantity and quality of naphtha produced as feedstock for an aromatics unit. In tests, decreasing the conversion in the hydrocracking unit from 80% to 60% resulted in an increase of 55% to 60% in the selectivity to naphtha. The same decrease in conversion altered the selectivity to aromatics in the naphtha from 30% to 38%. Recycle of the unconverted hydrocracker feedstock resulted in an overall conversion of 98%. These tests demonstrate the usefulness and the unique characteristics of this process.

While particular embodiments of the process have been shown and described, it will be appreciated by those skilled in the art that changes and modifications may be made thereto without departing from the invention in its broader aspects and as set forth in the following claims.

What is claimed is:

1. A process for improving p-xylene production comprising the steps of:

producing a naphtha fraction and a light cycle oil fraction from a fluid catalytic cracking zone;

combining the naphtha and light cycle oil fractions;

hydrotreating the combined naphtha and light cycle oil fractions to produce a hydrotreated product;

fractionating the hydrotreated product in a fractionation zone to make a light ends cut, a naphtha cut, a hydrocracker feed and an unconverted oil fraction;

sending the hydrocracker feed to a hydrocracking zone to make a hydrocracker product;

recycling the hydrocracker product to the fractionation zone, feeding the hydrocracker product above an outlet for the hydrocracker feed, but below an outlet for the naphtha cut;

sending the naphtha cut to a dehydrogenation zone, the dehydrogenation zone comprising a first portion of regenerated reforming catalyst from a catalyst regenerator;

moving the regenerated reforming catalyst downward through the dehydrogenation zone as it cokes to become lightly coked catalyst;

sending a product stream of the dehydrogenation zone to an aromatics extraction unit;

withdrawing an aromatic-rich extract and a raffinate from the aromatics extraction unit;

heating a straight run naphtha and the raffinate and feeding them to a first reforming zone, the first reforming zone comprising a second portion of regenerated reforming catalyst from the catalyst regenerator;

moving the regenerated reforming catalyst downward through the first reforming zone as it starts to become lightly coked catalyst;

removing the lightly coked catalyst from the first reforming zone and the dehydrogenation zone and feeding the lightly coked catalyst from both the first reforming zone and the dehydrogenation zone to the top of the second reforming zone;

heating an effluent from the first reforming zone and feeding it to a second reforming zone;

moving the lightly coked reforming catalyst downward through the second reforming zone as it becomes partially coked reforming catalyst;

removing the partially coked reforming catalyst from the second reforming zone and feeding it to a third reforming zone;

heating an effluent from the second reforming zone and feeding it to the third reforming zone to produce a reformate, the third reforming zone comprising the partially spent reforming catalyst;

moving the partially spent reforming catalyst downward through the third reforming zone as it becomes a substantially spent catalyst;

removing the substantially spent reforming catalyst from the third reforming zone;

regenerating the substantially spent reforming catalyst from the third reforming zone in the catalyst regenerator; and feeding the dehydrogenated naphtha to an aromatics recovery unit to recover p-xylene and other aromatics.

2. The process of claim 1 wherein the aromatics recovery unit utilizes an extraction with sulfolane.

3. The process of claim 1 wherein the hydrotreating step further comprises operating at a temperature of about 315° C. (600° F.) to about 426° C. (800° F.) and pressures of about 3.5 MPa-13.8 MPa (500 psig-2000 psig).

4. The process of claim 1 wherein the hydrotreating step further comprises utilizing a catalyst comprising molybdenum.

5. The process of claim 1 wherein the hydrotreating step further comprises utilizing a catalyst comprising at least one of cobalt, nickel and combinations thereof.

6. The process of claim 1 wherein the hydrotreating step further comprises selecting a weight hourly space velocity to produce the naphtha cut having a sulfur content of less than 1 ppm by weight.

7. The process of claim 1 wherein the hydrotreating step further comprises selecting a weight hourly space velocity such that the hydrocracker feed has a nitrogen content of less than 30 ppm by weight.

8. The process of claim 1 wherein the hydrocracking zone is operated at a temperature of about 371° C. (700° F.) to about 426° C. (800° F.) and at a pressure from about 3.5 MPa (500 psig) to about 17.3 MPa (2500 psig).

9. The process of claim 1 wherein a feedstock to the fluid catalytic cracking zone is a vacuum gas oil.

10. The method of claim 1 further comprising separating the reformate into multiple products.

11. The method of claim 1 wherein the reforming catalyst is supported on a crystalline zeolite aluminosilicate, a refractory support material or combinations thereof.

12. The method of claim 1 wherein the reforming catalyst comprises one or more platinum group metals.

13. The method of claim 1 wherein the catalyst moves through the dehydogenator and the reforming zones by gravity.

14. The method of claim 1 wherein the first and second charge heating zones are contained within the same heating device.

15. The method of claim 1 wherein the first and second interstage heating zones are contained within the same heating device.

16. The method of claim 1 wherein the reforming catalyst comprises a dual-function catalyst.

17. The method of claim 1 further comprising removing the reformate from the third reforming zone and separating it into multiple products.

* * * * *